US005190082A

United States Patent [19]

Watson et al.

[11] Patent Number: 5,190,082

[45] Date of Patent: Mar. 2, 1993

[54] METHOD AND APPARATUS FOR FILLING DUVETS AND THE LIKE

[75] Inventors: Julian M. Watson, Leeston; Ian D. McFarlane, Twin Creeks, both of New Zealand

[73] Assignee: Wool Research Organization of New Zealand, Inc., Lincoln, New Zealand

[21] Appl. No.: 656,964

[22] Filed: Feb. 19, 1991

Related U.S. Application Data

[63] Continuation-in-part of Ser. No. 423,229, Oct. 18, 1989, abandoned.

[30] Foreign Application Priority Data

Oct. 18, 1988 [NZ] New Zealand ..... 226613

[51] Int. Cl.[5] ..... B65B 1/16

[52] U.S. Cl. ..... 141/1; 141/10; 141/67; 141/114; 141/250; 406/135; 406/153; 406/155

[58] Field of Search ..... 141/1, 4, 5, 59, 67, 141/10, 114, 250; 406/135, 153, 123, 154–156, 181

[56] References Cited

U.S. PATENT DOCUMENTS

| | | | |
|---|---|---|---|
| 1,828,673 | 10/1931 | McJoynt | 141/67 |
| 2,047,215 | 7/1936 | McJoynt | 141/67 |
| 2,060,629 | 11/1936 | McJoynt | 141/67 |
| 2,550,354 | 4/1951 | Jacobsen | 406/135 |
| 2,721,767 | 10/1955 | Kropp | 406/135 |
| 3,527,502 | 9/1970 | Graham | 406/153 |
| 4,411,388 | 10/1983 | Muck | 406/153 |
| 4,761,857 | 8/1988 | McFarlane et al. | 141/98 |

*Primary Examiner*—Henry J. Recla
*Assistant Examiner*—Casey Jacyna
*Attorney, Agent, or Firm*—Watson, Cole, Grindle & Watson

[57] ABSTRACT

A method and apparatus for simultaneously filling separate compartments of a duvet by pneumatically fluidizing material from a drum with pulsed jets of air using a venturi effect.

8 Claims, 5 Drawing Sheets

METHOD AND APPARATUS FOR FILLING DUVETS AND THE LIKE

CROSS-REFERENCE TO RELATED APPLICATION

This application is a Continuation-in-Part of application Ser. No. 423,229 filed Oct. 18, 1989, now abandoned.

FIELD OF THE INVENTION

The present invention relates to a method and apparatus for filling duvets and the like, and more particularly to the filling of duvet compartments and the like with particulate padding and fill material. The term "duvets and the like" as used herein means lightweight bedding of the type normally having elongate compartments formed by sewing together two sheets of material either directly or through wall sections. The term includes both duvets, sleeping bags and the like. The method may also be suitable for filling pillows and other articles.

BACKGROUND TO THE INVENTION

At present duvets, sleeping bags and the like items which are constructed with elongate compartments are normally filled with a particulate material like down, feathers, wool, and more recently with the soft knops invented by the applicants and the subject of U.S. Pat. No. 4,761,857. The particulate material in the compartments forms a lightweight mass which acts as a padding and insulation material.

A problem with these padding materials is that it is difficult to fill the compartments evenly. This method differs in concept from prior art methods such as in McJoynt, U.S. Pat. No. 2,060,629 in that it is specifically designed for fi ling compartmented products with low density fills without the tendency to compress the fill. The machine has been specifically designed for filling duvets. The concept for a duvet is to have "warmth without weight". Typically, fill weights of less than 500 g per square meter are required, which can only be achieved with lightweight fills which would be capable of filling a space of more than forty millilitres per gram. To achieve these low weights a vacuum created by a pulsed venturi is needed to draw off discreet amounts of fill material from a fluidized reservoir. These discreet amounts are then transported down elongate members to the closed end of the compartments and deposited there by short pulses of air without compressing the fill. It was found in trials that if a continuous supply of air was used, as would be produced by a fan such as in the above-noted prior art patent to Mcjoynt, the fill would be unduly compressed into the compartments, or, alternatively, if the air pressure was reduced to overcome compressing of the fill material, this could cause obstructions blocking the elongate members. The method is ideally suited to use with soft knops (U.S. Pat. No. 4,761,857) which have a filling capacity of more than 60 ml/g.

Prior art such as McJoynt, Knopp (U.S. Pat. No. 2,721,767) and Jacobsen (U.S. Pat. No. 2,550,354), which are designed to fill densely packed products such as automotive cushions and the like, would compress the particulate materials at the closed ends of the compartments. At present this happens, and the compartments are then smoothed out by hand. This is particularly difficult for soft knops which are not always free flowing, as they have a tendency to form clumps when they are forced along elongate compartments.

An object of the present invention is therefore to provide a method and apparatus for filling compartments in duvets and the like with particulate padding materials.

Further objects of the invention will become apparent from the following description which is given by way of example.

SUMMARY OF THE INVENTION

According to a first aspect of the invention, there is provided a method of filling a compartment or compartments in a duvet and the like, the method including the steps of:

(1) holding in a generally horizontal plane a compartmented case for a duvet and the like;
(2) placing a supply of particulate fill material in a main hopper drum;
(3) sucking particulate material, on demand, from the main hopper drum with a material handling fan;
(4) blowing the particulate material into a secondary hopper;
(5) optionally spraying a measured dose of water onto the material as the material passes through the material handling fan in order to suppress static charges;
(6) dropping small amounts of the particulate fill material from the secondary hopper, on demand, into a fluidizing drum;
(7) placing in at least one of the compartments of the duvet an elongate hollow member with its open end near to a closed end of the compartment;
(8) connecting to each elongate hollow member a separate outlet from the fluidizing drum;
(9) fluidizing the supply of fill material in the fluidizing drum;
(10) withdrawing under partial vacuum from the fluidizing drum in a pulsed manner discreet amounts of the fill material; and
(11) depositing, under air pressure, the discreet amounts of fill material through the elongate member(s) into the closed end(s) of the compartment(s) so that the compartment(s) is (are) filled incrementally as the elongate member(s) or the compartmented case are moved apart relative to each other.

According to a second aspect of the, there is provided an apparatus for filling a compartment or compartments of a duvet and the like, the apparatus including a means for holding a compartmented case of a duvet and the like in a generally horizontal plane, a main hopper drum for a supply of particulate fill material, a material handling fan to suck the particulate fill on demand into a secondary hopper, and optionally a water spray to suppress the generation of static electricity in the fill material to drop small amounts of the fill material on demand into a fluidizing drum, the fluidizing drum having means connected to an outlets or outlets of the drum, each means being connected to an individual elongate hollow member, the elongate member(s) and the means for holding the case being movable relative to each other so that when a fill material in the drum is fluidized and pulsed from the outlet or outlets to the hollow individual members(s) it fills the closed end(s) of the compartment(s), the hollow individual member(s) which are initially within the compartments are gradually withdrawn as the compartment(s) is (are)

filled by the fill material from the elongate hollow member(s).

The apparatus can include any number of elongate members, typically up to ten, which extend horizontally at equal spacings from a support frame. The number of elongate members is chosen so that in one or two operations of the apparatus duvets which have up to 20 compartments are filled.

The fluidizing drum can fluidize the fill material therein by rotating paddles which spread the fill material evenly around the drum so that they can be drawn therefrom pneumatically by pulsed jets of air which use a venturi effect to withdraw the fill material and direct same along the elongate hollow members.

Further aspects of the invention which should be considered on all its novel aspects will become apparent from the following description.

Examples of the invention with now be described with reference to the accompanying drawings.

DESCRIPTION OF THE PREFERRED EMBODIMENTS

In the first embodiment as shown in FIGS. 1 to 6 the invention utilizes (as shown in detail in FIGS. 4 to 6) a drum 1 in which a supply of fill material is retained in a fluidized state. During operation the fill material (not shown) is fed to the drum 1 whenever a sensor 2 indicates that the fill level is below a predetermined level. The fill is supplied from a main hopper (not shown in FIGS. 1 to 6).

Figure 6:
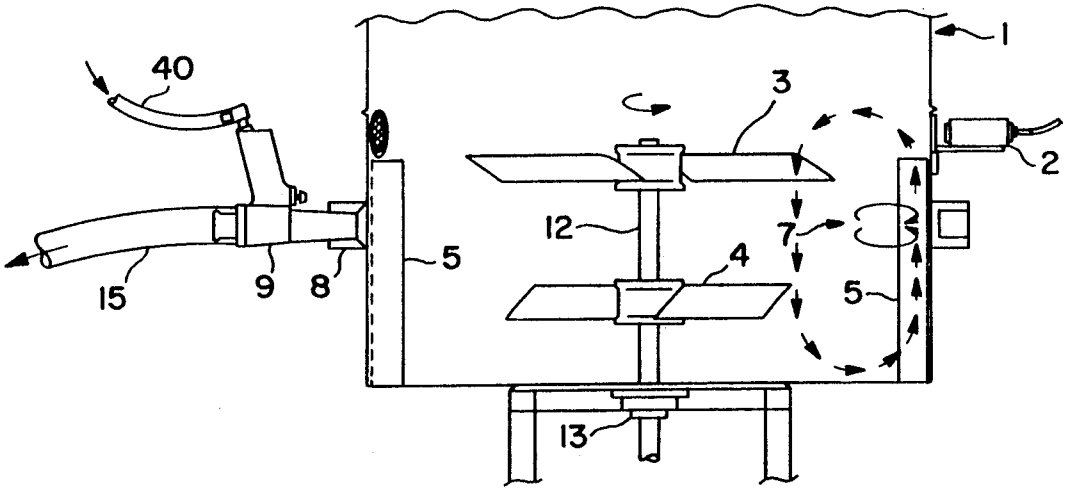
FIG. 6 is a detailed section on an enlarged scale though the fluidizing drum shown in FIGS. 4 and 5.

In this embodiment the fill material is fluidized by the incorporation of a pair of paddle blades 3, 4 which are shaped to rotate in the same direction and produce an airflow as shown by the arrows in FIG. 6. The drum 1 includes baffles 5 which ensure that an even distribution of the fill material is in feed out zones 7 of the drum 1.

Figure 5:
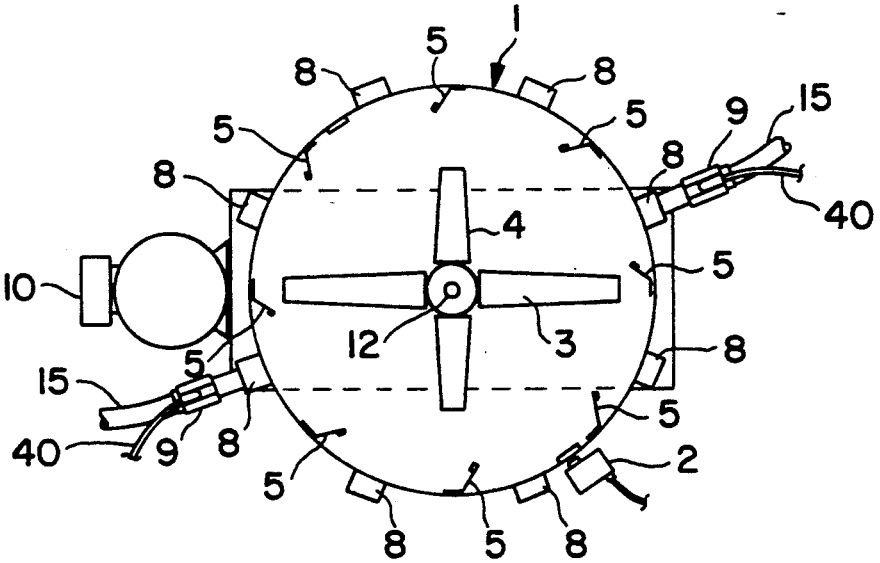
FIG. 5 is a plan view of the drum shown in FIG. 4.
Figure 7:
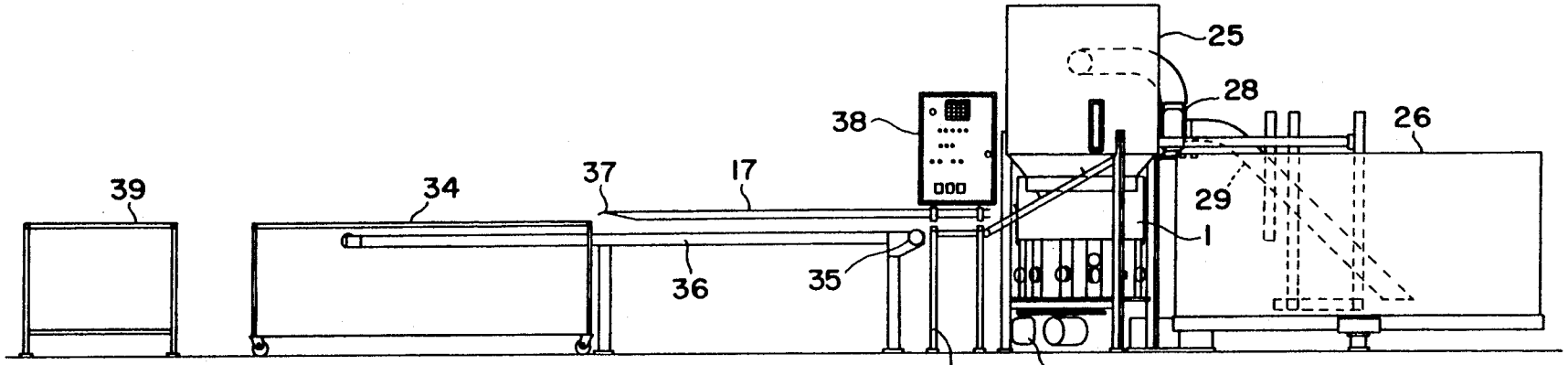
FIG. 7 is a side view of a preferred example of apparatus according to the present invention.
Figure 8:
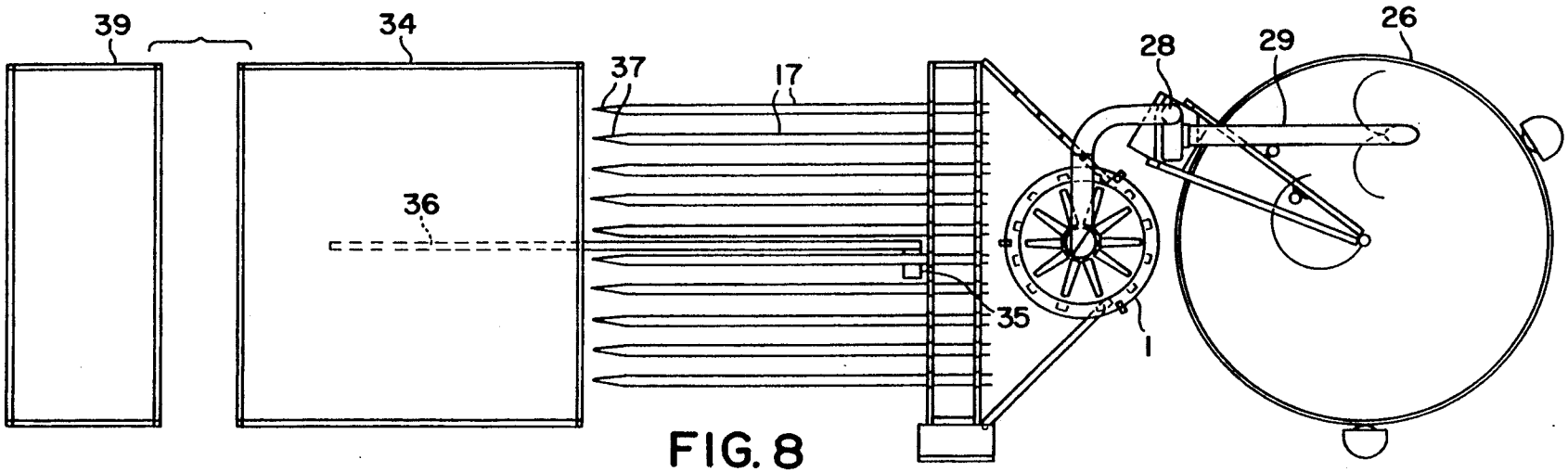
FIG. 8 is a schematic plan view of the apparatus shown in FIG. 7.
Figure 10:
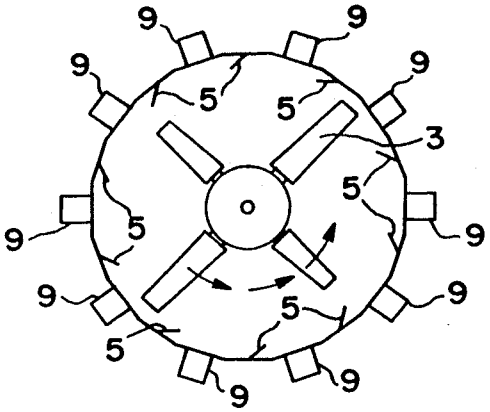
FIG. 10 is a section through the fluidizing drum in the direction of arrows x—x in FIG. 9.
Figure 11:
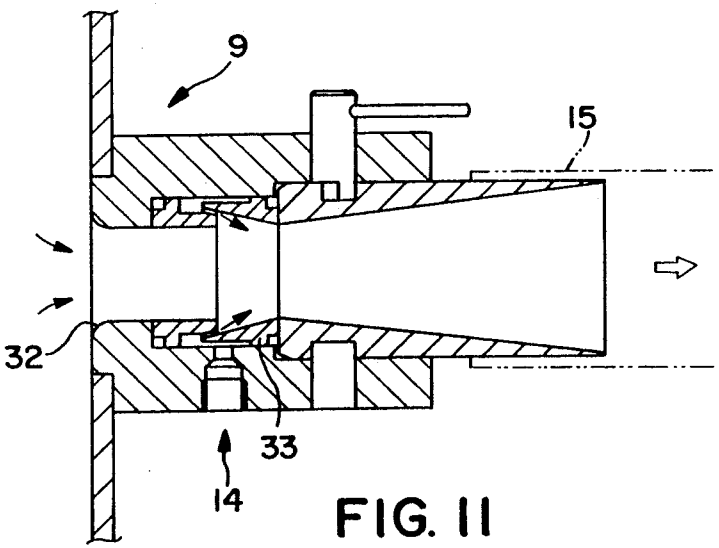
FIG. 11 is a section at B (FIG. 9) through an outlet from the fluidizing drum.
Figure 9:
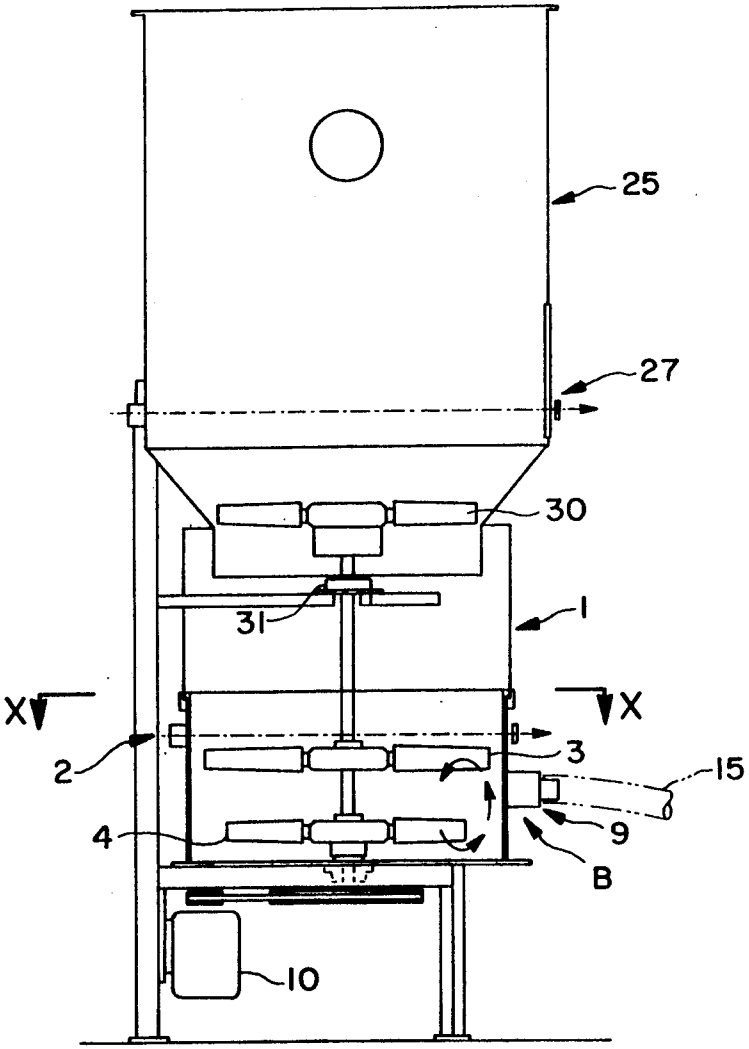
FIG. 9 is a vertical section through the secondary hopper and fluidizing drum of the apparatus shown in FIGS. 7 and 8.

The drum 1 has in the periphery of the feed out zone 7 at least one and preferably as shown up to eight outlets 8. Each outlet has a venturi injector outlet 9 (only two of which are indicated in FIG. 5) into which air is pulsed.

The paddle blades 3, 4 are driven by an electric motor 10 via a drive belt 11. The paddle blades are designed to stir the air around the fill material, and hence fluidize the material, without damaging it. The drive shaft 12 on which the blades 3,4 are mounted is itself mounted by bearings 13 in the base 14 of the drum 1.

The venturi injector outlet 9 has an air inlet via line 40. The venturi is created by air under pressure passing through jets into a connecting hose 15.

Figure 1:
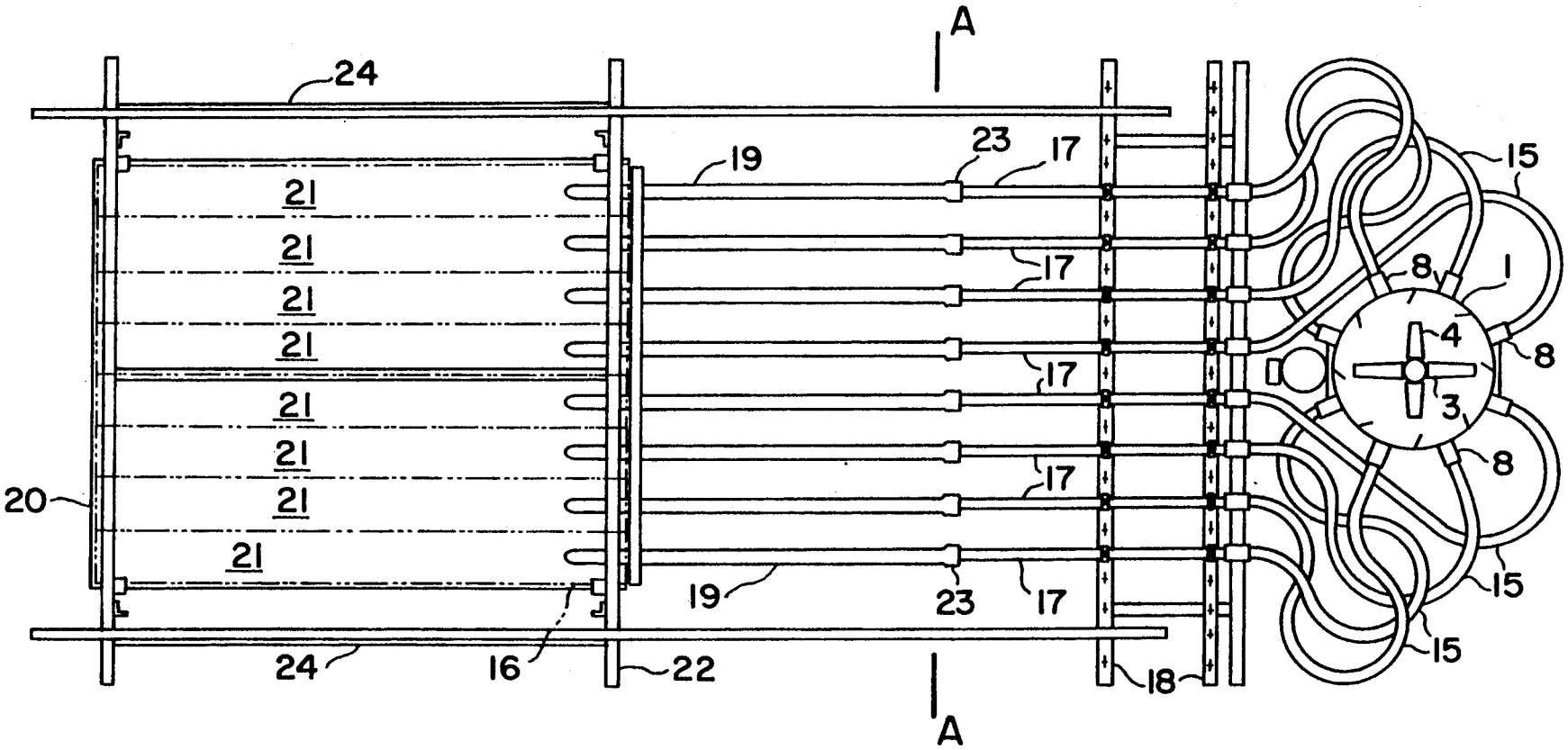
FIG. 1 is a schematic plan view of a first apparatus according to the present invention with the elongate hollow members in their retracted position.
Figure 3:
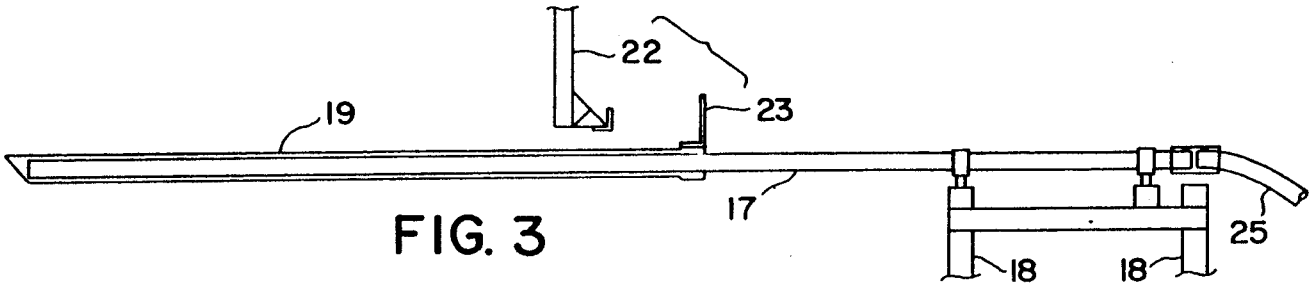
FIG. 3 is a side view of part of one of the elongate hollow members in their retracted position.
Figure 2:
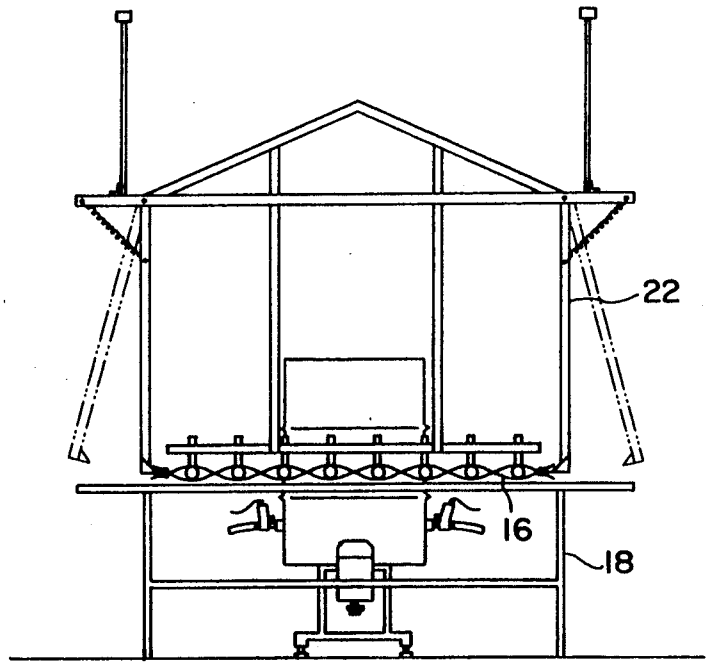
FIG. 2 is an end view of the apparatus shown in FIG. 1 wherein the elongate members are in their stop position.
Figure 4:
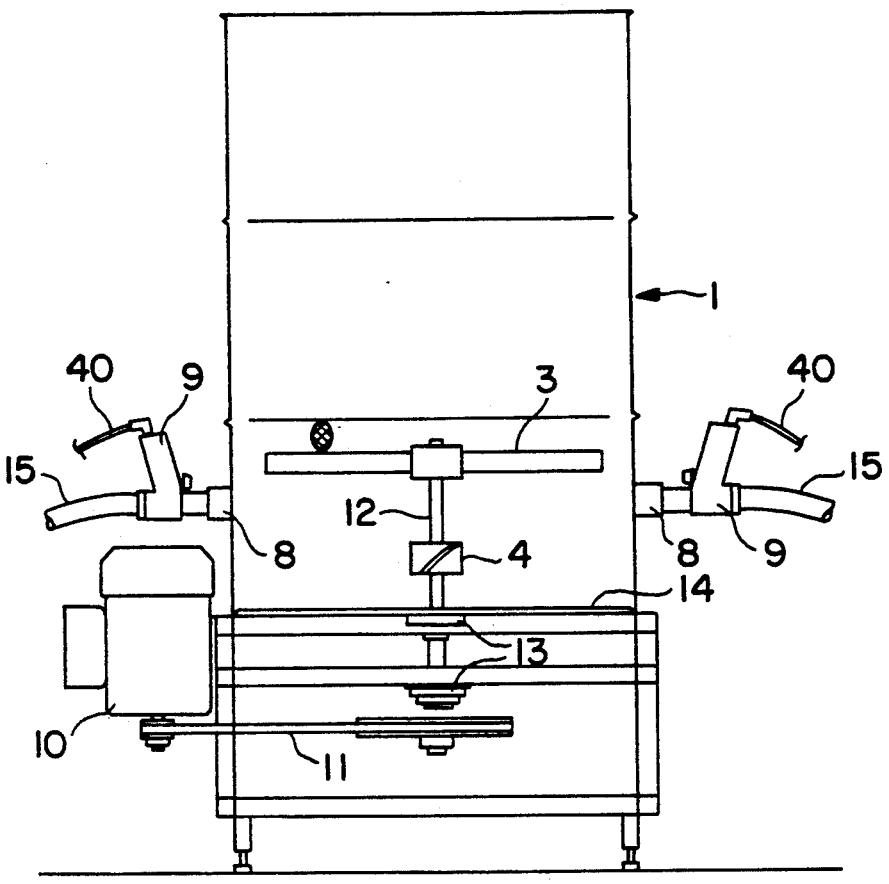
FIG. 4 is a cross-section through a fluidizing drum in which a supply of fill material is maintained.

The filling apparatus additionally includes means for supporting a duvet case 16 as shown in FIGS. 1 and 2. The means is preferably in a horizontal plane. The apparatus includes a series of elongate members 17 supported by a frame 18. The members 17 are initially extended to within the compartments in the duvet case 16. The elongate members 17 are extended by including tubular members 19 thereon. The tubular members 19 assist in lining up and placement of the elongate members 17 into the closed end 20 of the compartments 21 of the duvet case. The tubular members 19 are movable relative to the elongate members 17 as either they are withdrawn or the support carrying the duvet case 16 is withdrawn. In this example the tubular members 19 are withdrawn by a movable frame 22 which is moved by hand or automatically to the position A shown in FIG. 1. The movement is assisted by the stops 23 at one end of the tubular members 19. The frame is then moved by hand or automatically to the position shown in FIG. 1 as the compartments 21 are filled.

The outlet zones 7 from the drum 1 are connected by flexible hoses 15 or the like to the end of the elongate members 17 so that in operation material from the drum 1 is deposited by air pressure through the elongate members into the ends of the compartments in the duvet case 16.

The applicants experiments have shown that pulses of air from 0.04 to 0.3 seconds and 3 bar gauge pressure at 3 second intervals will fill the duvet case with 2kg of soft knops in less than 6 minutes. In practice, a control system (not shown) is utilized which pulses air to the injector outlets 9 at the same time so that the compartments are filled evenly. The paddles are rotated at 300 rpm in this prototype. In a practical apparatus the machine will either automatically or manually allow for adjustments in the air pressure. At the end of filling the first eight compartments, the elongate members 17 or the frame 24 supporting the duvet case 16 can be moved to the side to allow the elongate members to be inserted into the next series of compartments, so that they can be filled.

In the preferred embodiment shown in FIGS. 7 to 11 the apparatus will be described with similar parts from the first example being referenced by the same numerals.

In this example the fluidizing drum 1 is mounted with its axis vertical. The fluidizing drum 1 is supported beneath a feed or secondary hopper 25 which is supplied with soft knops from main hopper drum 26 rotating at approximately 1 rev per min, counterclockwise as is shown in the plan view FIG. 8. The main hopper drum 26 can hold a minimum of 75 kg of soft knops. On command from a level sensor 27 of the secondary hopper 25 a material handling fan 28 sucks up through trailing hose 29 soft knops at a rate of 2–3 kg/min, and blows it into the intermediate hopper 25. A fine water jet is sprayed onto the soft knops as they pass through the fan, to suppress any static electricity generation.

Secondary hopper 25 holds 1–2 kg of soft knops and on command from level sensor 2 a fan 30 slowly revolves and dribbles soft knops down into the fluidizing drum 1. The fan 30 is driven by a motor 10 through a clutch 31. The fluidizing drum 1 holds approximately ½ kg of soft knops. The drum 1 has two rotors 3, 4 driven directly by motor 10 in an a counter clockwise direction as shown in plan view in FIG. 10 at approximately 275 rpm. The rotors 3, 4 keep the soft knops in a fluidized, loosely packed mass with the aid of the constraints of the distributor drum 1 itself and baffle plates 5. Their blades are designed to ensure no damage is done to the soft knops.

Soft knops are removed from the fluidizing drum 1 by air venturi injector outlets 9 of which there are 10 around the fluidizing drum 1. Each air venturi is the same, and an example is shown in more detail in FIG. 11. Each simultaneously uses approximately 0.2 liters free air at approximately 4 bar gauge pressure for approximately 1/20 sec from high pressure inlet 14 through a venturi element 33. This causes a pulse of air and soft knops to be sucked through drum outlet 32 and lightly blown down a flexible tube 15 (not shown in FIGS. 7 and 8) and from there via an elongate hollow member 17, supported by frame 18, tube 28 (FIGS. 7 and 8) into a duvet case (not shown) located on a movable table 34.

Typically four pulses occur every second, each pulse carrying 1 gram of soft knops. Hence the combined ten members 17 are capable of delivering approximately 2400 g of soft knops per minute.

The gentle action of the rotors 3, 4 and their fluidizing effect in the soft knops within the fluidizing drum 1, combined with the effect of the venturi injector outlet 9 to suck the soft knops out in discreet pulses and deposit them just outside the ends of the elongate hollow members and in the required position within the duvet compartment, is the key to this invention.

The movable table 34 is driven by a motor 35 (FIG. 8) via a chain 36 which is automatically controlled so that an empty duvet shell on the table 34 is threaded over the elongate hollow members 17 until the open ends 37 of the members 17 are close to the closed end of the empty duvet shell.

The movable table 34 is then driven in such a way that the duvet compartments are filled evenly from one end to the other, needing only a sewing up procedure to complete the product.

Also shown in the drawings is a control panel 38 and a fixed table 39, which is used for preparing the duvet shells prior to attaching them to the movable table 34.

In practical trials this machine has proven itself capable of filling 40 Queensize duvet shells (2.1 m×2.1 m) containing 2 kg each of evenly spread soft knop fill in one hour, with the aid of two operators.

Thus, by this invention there is provided an apparatus for filling a duvet and the like with particulate fill or padding material.

Particular examples of the invention have been described and it is envisaged that improvements and modifications can take place without departing from the scope and spirit of the appended claims.

What we do claim and desire to obtain by Letters Patent of the United States is:

1. A method of simultaneously filling a plurality of separate compartments in a duvet or the like, the method including the steps of:

(1) positioning a compartmented case for a duvet or the like in a generally horizontal plane;
(2) placing a supply of particulate fill material in a main hopper drum;
(3) sucking particulate material, on demand, from the main hopper drum with a material handling fan;
(4) blowing the particulate material into a secondary hopper;
(5) optionally spraying a measured dose of water onto the material as the material passes through the material handling fan in order to suppress static charges;
(6) dropping small amounts of the particulate fill material from the secondary hopper, on demand, into a fluidizing drum;
(7) providing a plurality of elongate hollow members and placing a respective elongate hollow member in at least two compartments of the duvet or the like such that an open end of each elongate hollow member is located near a closed end of the respective compartment;
(8) connecting to each elongate hollow member a separate outlet from the fluidizing drum;
(9) fluidizing the supply of fill material in the fluidizing drum;
(10) withdrawing under partial vacuum from the fluidizing drum in a pulsed manner discreet amounts of the fill material; and
(11) simultaneously passing, under air pressure, the discreet amounts of fill material through the respective elongate members and into the closed ends of the respective compartments and moving said compartmented case and said elongated members apart so that the compartments become simultaneously incrementally filled as the elongate members and the compartmented case are moved apart.

2. An apparatus for simultaneously filling a plurality of separate compartments in a duvet or the like, the apparatus including a means for holding a compartmented case of a duvet or the like in a generally horizontal plane, a main hopper drum for a supply of particulate fill material, a secondary hopper, a material handling fan for sucking the particulate fill on demand from the main hopper into said secondary hopper, means to optionally spray water onto the particulate fill material as it passes through said material handling fan, a fluidizing drum which receives said fill material from said secondary hopper and includes a plurality of outlets, a plurality of elongated hollow members, means connected to said plurality of outlets of the drum to connect a respective outlet to a respective elongated hollow member and deliver a pulsed supply of fill material thereto, the elongate hollow members and the means for holding the compartmented case being movable relative to each other so that when a fill material in the drum is fluidized and pulsed from the outlets to the hollow individual members it fills closed ends of the compartments, the hollow individual members which are initially within the compartments are gradually withdrawn as the compartments are simultaneously filled by the fill material from the elongated hollow members.

3. An apparatus as claimed in claim 2, including a support frame for supporting said plurality of elongate members so as to extend horizontally with equal spacing therebetween.

4. An apparatus as claimed in claim 3, including two elongate members.

5. An apparatus as claimed in claim 4, wherein the drum includes paddles which, when rotated, fluidize the fill material therein and spread the fill material evenly around the drum so that it can be drawn therefrom pneumatically by pulsed jets of air which use a venturi effect to withdraw the fill material and direct same along the elongate hollow members.

6. An apparatus as claimed in claim 5, including a fan for delivering fill material from said secondary hopper into said drum.

7. An apparatus as claimed in claim 6, including means for fluidizing the fill in said secondary hopper to assist its transportation to the drum.

8. An apparatus as claimed in claim 2, wherein said means connecting said plurality of outlets of the drum to respective elongate hollows members comprise separate hoses having respective venturi injector outlets therein.

* * * * *